United States Patent [19]

Higashi et al.

[11] Patent Number: 4,762,048

[45] Date of Patent: Aug. 9, 1988

[54] APPARATUS FOR UNIFORMING HEAT OF GUN BARREL

[75] Inventors: Izumi Higashi; Akio Adachi; Takayoshi Tajima; Norimichi Hiroshige, all of Kanagawa, Japan

[73] Assignee: Fuji Electric Co., Ltd., Kanagawa, Japan

[21] Appl. No.: 917,546

[22] Filed: Oct. 10, 1986

[30] Foreign Application Priority Data

Oct. 11, 1985 [JP] Japan ..... 60-226312

[51] Int. Cl.[4] ..... F41F 17/14

[52] U.S. Cl. ..... 89/14.1; 165/47

[58] Field of Search ..... 89/14.05, 14.1, 16; 165/47 H, 104.26, 135

[56] References Cited

U.S. PATENT DOCUMENTS 3,847,208 11/1974 Ollendorf ..... 165/47 H 4,346,643 8/1982 Taylor et al. ..... 89/14.1

4,638,713 1/1987 Milne et al. ..... 89/14.1

FOREIGN PATENT DOCUMENTS 1918422 10/1970 Fed. Rep. of Germany ..... 89/14.1

60-7867 8/1985 Japan .

133091 10/1919 United Kingdom ..... 89/14.1

*Primary Examiner*—Stephen C. Bentley

*Attorney, Agent, or Firm*—Finnegan, Henderson, Farabow, Garrett & Dunner

[57] ABSTRACT

An apparatus for uniforming the heat of a gun barrel includes an heat-pipe type dissipation cylinder attached to an outer periphery of the gun barrel along the longitudinal direction thereof for uniforming the heat of the barrel, and a heat insulating cover coating the heat-pipe type dissipation cylinder for covering an outer periphery thereof and shading the heat-pipe type dissipation cylinder from solar radiation.

5 Claims, 1 Drawing Sheet

APPARATUS FOR UNIFORMING HEAT OF GUN BARREL

BACKGROUND OF THE INVENTION

This invention relates to an apparatus for uniforming the heat of a gun barrel by shrouding a gun of, e.g., a tank with a heat-pipe type dissipation cylinder for dissipating heat locally generated because of solar radiation or as the result of shooting so as to improve shooting accuracy.

On receiving solar radiation, the temperature of the upper side of a barrel of a gun mounted on a tank and the like is sharply raised by solar heat and, on the contrary, the temperature of the lower side thereof is only slightly raised. For this reason, the difference in thermal expansion accompanied by the difference in temperature between the upper and lower sides is known to cause the front end of a gun barrel, if it is long, to slightly curve downward. Since the extent to which the barrel is curved varies with weather conditions and so on, it allows of reduction in shooting accuracy.

Moreover, the inside wall of a barrel is subjected to impacts because of gas resulting from the combustion of a propellant every time a shell is shot. The further addition of heat generated by the mechanical abrasion between the shell and the inside wall of the gun barrel raises the temperature thereof, thus affecting the life of the material used. Furthermore, the contact resistance between the shell and the barrel changes as the caliber of the gun barrel expands because of thermal expansion and also affects the initial velocity of the shell, thus decreasing shooting accuracy.

In order to improve shooting accuracy, as shown in FIG. 1, an annular heat-pipe type dissipation cylinder 4 is tightly conductively attached to the outer periphery of a gun barrel 2 projecting from a gun turret 1 so as to transfer heat quickly from a high temperature zone to a low temperature one by making use of the evaporation of hydraulic fluid in the heat pipe and latent heat resulting from condensation cycles, thereby efficiently to disperse the heat locally generated throughout the whole area of the barrel. An apparatus for uniforming the heat of a gun barrel by dissipating the heat thus generated in the manner described above has already been proposed by the present inventors (Japanese Utility Model Application No. 7867/84).

In that case, the barrel 2 is, as shown in FIG. 1, equipped with a smoke discharger 3 halfway and formed in such a manner that the outer diameter of the gun barrel is made gradually thinner from the base on the turret side toward the front end thereof. When the heat-pipe type dissipation cylinder 4 is attached to the long barrel 2, the dissipation cylinder 4 is divided into a plurality of pieces beforehand in the longitudinal direction of the gun barrel 2 and the thus divided pieces of the heat-pipe type dissipation cylinder are arranged one after another and attached to the barrel, each of the independently built pieces conforming in dimension to each barrel block in the corresponding fitting position. Through the method of individually attaching the pieces thereof, they are readily fabricated and attached thereto and, in case part of the heat pipe is bombed and damaged, the loss of the function of the heat pipe is limited to that portion and advantageously prevented from spreading over the whole heat dissipation cylinder.

FIGS. 2 and 3 show the construction of the above divided heat pipe type dissipation cylinder. Each piece of the heat-pipe type dissipation cylinder 4 obtained by dividing it into a plurality of pieces along the longitudinal direction of the barrel comprises a C-shaped inner cylinder 5 and outer cylinder 6 made of sheets mutually sealing welded, a ring flange 7 for closing both axial edge faces between the inner and outer cylinders 5, 6 and a linear flange 8 for closing the edge faces of a cut P on the periphery. These parts constitute a tightly closed cylinder of double construction which is C-shaped in cross section. A heat-pipe hydraulic fluid is supplied to the closed internal space, whereas a wick 9 is bonded to the inner walls of the inner cylinder 5 and the outer cylinder 6. A space 10 for allowing the hydraulic fluid to evaporate is formed inside the outer cylinder 6. Moreover, clamping flanges 11 face each other with the cut P between and clamping bolts 12 tighten the flanges. The actuation of heat pipe is made in the manner described above and the the heat locally generated is thermally transferred from the high temperature zone to the low temperature zone on the evaporation-condensation cycle to uniform and radiate the heat throughout the whole area of the dissipation cylinder. To attach the heat-pipe type dissipation cylinder 4 to the gun barrel 2, the axial cut P is widened to have the gun barrel covered therewith and subsequently the clamping bolts 12 are used to tighten the clamp flanges 11 at several places so that the heat dissipation cylinder may be firmly attached to the whole periphery of the gun barrel.

The gun barrel thus enclosed with the cylinder is less affected by solar heat and what is generated by shooting to a certain extent and contributes to the improvement of shooting accuracy. On the other hand, the conventional heat-pipe type dissipation cylinder limits the heat-uniforming performance and, because the periphery of the heat dissipation cylinder is most subjected to direct solar radiation, the amount of solar heat intruding into the cylinder is large. Therefore, solar heat greatly affects the heat-uniforming properties of the gun barrel on its peripheral direction and the disadvantage is that shooting accuracy is insufficiently improvable. In consequence, it has been called for to improve the apparatus for uniforming the heat of a gun barrel contributable to the improvement of shooting accuracy by minimizing the thermal effect of solar radiation thereon.

SUMMARY OF THE INVENTION

In view of what has been set forth above, the present invention is intended to improve the conventional apparatus for uniforming the heat of a gun barrel equipped with above heat-pipe type dissipation cylinder and it is therefore an object of the invention to provide an apparatus for uniforming the heat of a gun barrel less thermally affected by solar heat and capable of further increasing the outcome of the improvement of shooting accuracy through the installation of a heat-pipe type dissipation cylinder.

In order to accomplish the above object, the heat-pipe type dissipation cylinder attached to the barrel is coated with a heat insulating cover for covering the outer periphery thereof and simultaneously screening the dissipation cylinder from the sun and, by shading solar radiation and minimizing the intrusion of solar heat applied to the heat dissipation cylinder with the insulating cover, the difference in the temperature distribution in the peripheral direction is reduced, so that shooting accuracy is further improved with the increased uniforming-heat effect on the dissipation cylinder.

DETAILED DESCRIPTION OF THE INVENTION

Figure 1:
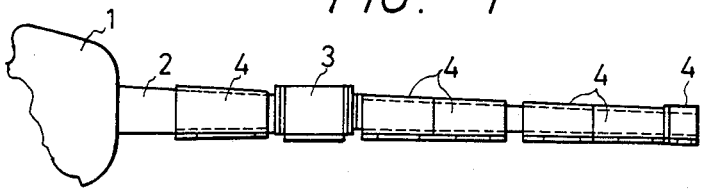
FIG. 1 is a side view of the whole barrel in such a state that a heat-pipe type dissipation cylinder is attached to the gun barrel.
Figure 2:
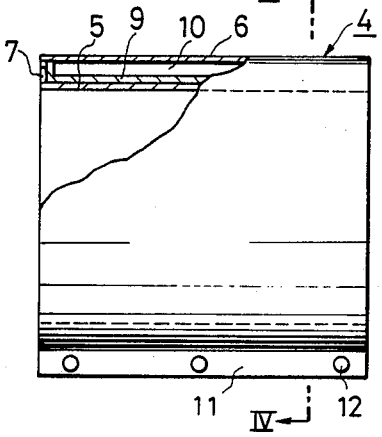
FIG. 2 is a partial cutaway side view of a heat-pipe type dissipation cylinder of a conventional apparatus.
Figure 3:
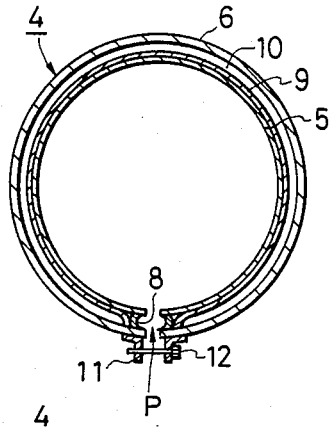
FIG. 3 is a sectional view taken on line IV—IV of FIG. 2.
Figure 4:
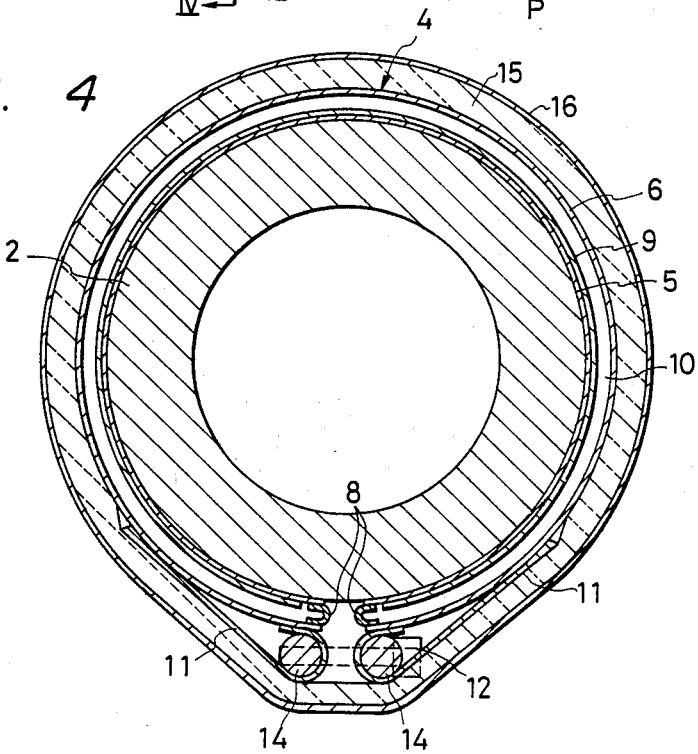
FIG. 4 is a structural sectional view of an apparatus for uniforming the heat of a gun barrel embodying the present invention.

FIG. 4 shows the construction of an apparatus for uniforming the heat of a gun barrel according to the present invention, wherein like reference characters designate like and corresponding parts of FIGS. 1 through 3. As shown in FIG. 4, a heat-pipe type dissipation cylinder 4 which is C-shaped in cross section comprises an inner cylinder 5, an outer cylinder 6, ring flanges 7 (not shown) and a wick 9. Hair-pin-like clamping bands 11 are first welded to both ends on the underside of the dissipation cylinder in the peripheral direction and then a tension rod 14 is inserted into each band 11. Clamping bolts 12 are used to clamp the tension rods 14 and the dissipation cylinder 4 is tightly fixed to the outer periphery of the gun barrel 2. The heat-pipe type dissipation cylinder 4 according to the present invention is coated through a clamping band 16 with a heat insulating cover for covering the whole outer periphery and simultaneously shading solar radiation.

With the above construction, the heat-pipe type dissipation cylinder 4 is attached to the gun barrel 2 and the dissipating cylinder is coated with the heat insulating cover 15 as shown in FIG. 1. Accordingly, solar heat is received once by the insulating cover 15 in such a state that the gun barrel is exposed to solar radiation. Due to the heat insulating effect, solar heat is prevented from directly intruding into the heat-pipe type dissipation cylinder 4. The amount of solar heat intruding into the heat-pipe type dissipation cylinder 4 is reduced, whereby heat uniforming properties in the peripheral direction is improved and the temperature distribution in the peripheral direction relative to the barrel 2 can be uniformed further. Since the openings of the flanges on the underside of the gun barrel 2 are also coated with the insulating cover 15, the openings are prevented from being cooled locally by the air and the gun barrel is thus less affected by solar heat, so that shooting accuracy is far improved in compared with the conventional construction.

As set forth above, the heat-pipe type dissipation cylinder attached to the outer periphery of the gun barrel is coated with the heat insulating cover for covering the outer periphery of the dissipation cylinder and simultaneously shading solar radiation and solar heat is prevented from directly intruding into the heat-pipe type dissipation cylinder to the extent that the thermal effect thereof is suppressed, whereby the shooting accuracy of the gun barrel is improvable.

What is claimed is:

1. An apparatus for the uniform heating of a gun barrel having an outside peripheral surface, comprising:

first and second spaced arcuate members having aligned edges, said members being disposed substantially parallel to each other to form, respectively, inner and outer arcuate walls for substantially encircling the gun barrel, said first and second members each having opposing parallel edges extending longitudinaly along the gun barrel with the first member being in intimate contact with the outside peripheral surface of the gun barrel, said arcuate members being sealed at the edges thereof forming a chamber therebetween;

a liquid substantially filling the chamber;

a wick disposed in the chamber for providing capillary circulation for the liquid;

a heat insulating cover in intimate contact with the entire second arcuate member, the heat insulating cover substantially encircling the gun barrel;

said liquid uniformly dissipating heat generated from the interior of the gun barrel and the interior of the heat insulating cover; and said heat insulating cover being operative to shade the second arcuate member from solar radiation.

2. The apparatus as recited in claim 1, wherein the first and second arcuate members are divided into a plurality of pieces along the longitudinal direction of the gun barrel.

3. The apparatus as recited in claim 2, wherein the first and second arcuate members are C-shaped in cross section.

4. The apparatus as recited in claim 3, wherein each piece of the first and second arcuate members includes clamping hands welded to the opposing parallel edges of said second arcuate member, a tension rod inserted into each of said clamping bands, and clamping bolts for clamping said tension rods to tightly fix the first and second arcuate members to the outside peripheral surface of the gun barrel.

5. The apparatus as recited in claim 2, wherein the heat insulating cover comprises a clamping band for covering the entire outside peripheral surface of the second arcuate member.

* * * * *